United States Patent [19]

Smallegan et al.

[11] Patent Number: 5,070,715

[45] Date of Patent: Dec. 10, 1991

[54] INTERCHANGEABLE LOCK CORE CYLINDER

[75] Inventors: Jon M. Smallegan; Frederick M. Hensley, both of Colorado Springs, Colo.

[73] Assignee: Schlage Lock Company, San Francisco, Calif.

[21] Appl. No.: 649,538

[22] Filed: Jan. 28, 1991

[51] Int. Cl.[5] ..... E05B 27/00

[52] U.S. Cl. ..... 70/369; 70/371

[58] Field of Search ..... 70/369, 368, 367, 371

[56] References Cited

U.S. PATENT DOCUMENTS

| | | | |
|---|---|---|---|
| 3,324,693 | 6/1967 | Check | 70/369 |
| 3,603,123 | 9/1971 | Best | 70/364 |
| 4,294,093 | 10/1981 | Best et al. | 70/369 |
| 4,404,825 | 9/1983 | Dixon | 70/368 |
| 4,444,034 | 4/1984 | Best et al. | 70/369 |
| 4,715,201 | 12/1987 | Craig | 70/369 |

*Primary Examiner*—Gary L. Smith
*Assistant Examiner*—Suzanne L. Dino
*Attorney, Agent, or Firm*—Robert F. Palermo

[57] ABSTRACT

An interchangeable lock core cylinder for use with a lock housing has a cylindrical body with a pin chest attached and parallel thereto, a rotatable key plug inserted within the cylindrical body, provision for capturing the core in the housing, and a mechanism within the key plug for selectively operating the capturing provision. This mechanism allows rapid insertion, removal, and replacement of lock core cylinders using an appropriate control key. When installed, the core cylinder is locked into engagement with the housing and has a positive latching provision so that it cannot be removed without use of the control key.

8 Claims, 2 Drawing Sheets

INTERCHANGEABLE LOCK CORE CYLINDER

BACKGROUND OF THE INVENTION

This invention relates generally to door locks having a pin tumbler locking mechanism, and more particularly to changing the pin tumbler combination by use of a replaceable lock core cylinder.

It is often desirable to change the pin tumbler combinations of several locks for a variety of reasons. When such changes are necessary, it is potentially both expensive and time-consuming. In order to minimize these drawbacks, rekeying systems have been developed with varying degrees of desirability. Some require excessive disassembly of the lock mechanism in order to change keying. Others, although relatively easy to replace, compromise security by allowing relatively easy removal by unauthorized persons, because they are susceptible to tampering.

Even without tampering, some replaceable cylinders are subject to inadvertent removal. For example, in locations where the lock mechanism is subject to corrosion or build-up of contaminants, the interface between the key plug and the core cylinder retention mechanism may become tight enough to disengage the retention mechanism and permit removal of the core cylinder with a standard key while merely trying to unlock the lock. This is most likely to happen in the case where the retention device is spring loaded and has become contaminated or worn due to long use, abuse, or tampering. These are well-known disadvantages of the present state of the art.

The foregoing illustrates limitations known to exist in present interchangeable lock core cylinders. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an interchangeable lock core cylinder, for use with a lock housing, comprising a cylindrical body, a pin chest having a transverse bore containing a locking pin for engaging a recess in the housing attached to the cylindrical body and parallel thereto, a locking pin stop latch which prevents retraction of the locking pin, a key plug inserted for rotation within the cylindrical body; and a control pin within the key plug for selectively operating the locking pin and the locking pin stop latch.

The foregoing and other aspects will become apparent from the following detailed description of the invention when considered in conjunction with the accompanying drawing figures.

DETAILED DESCRIPTION

Figure 1:
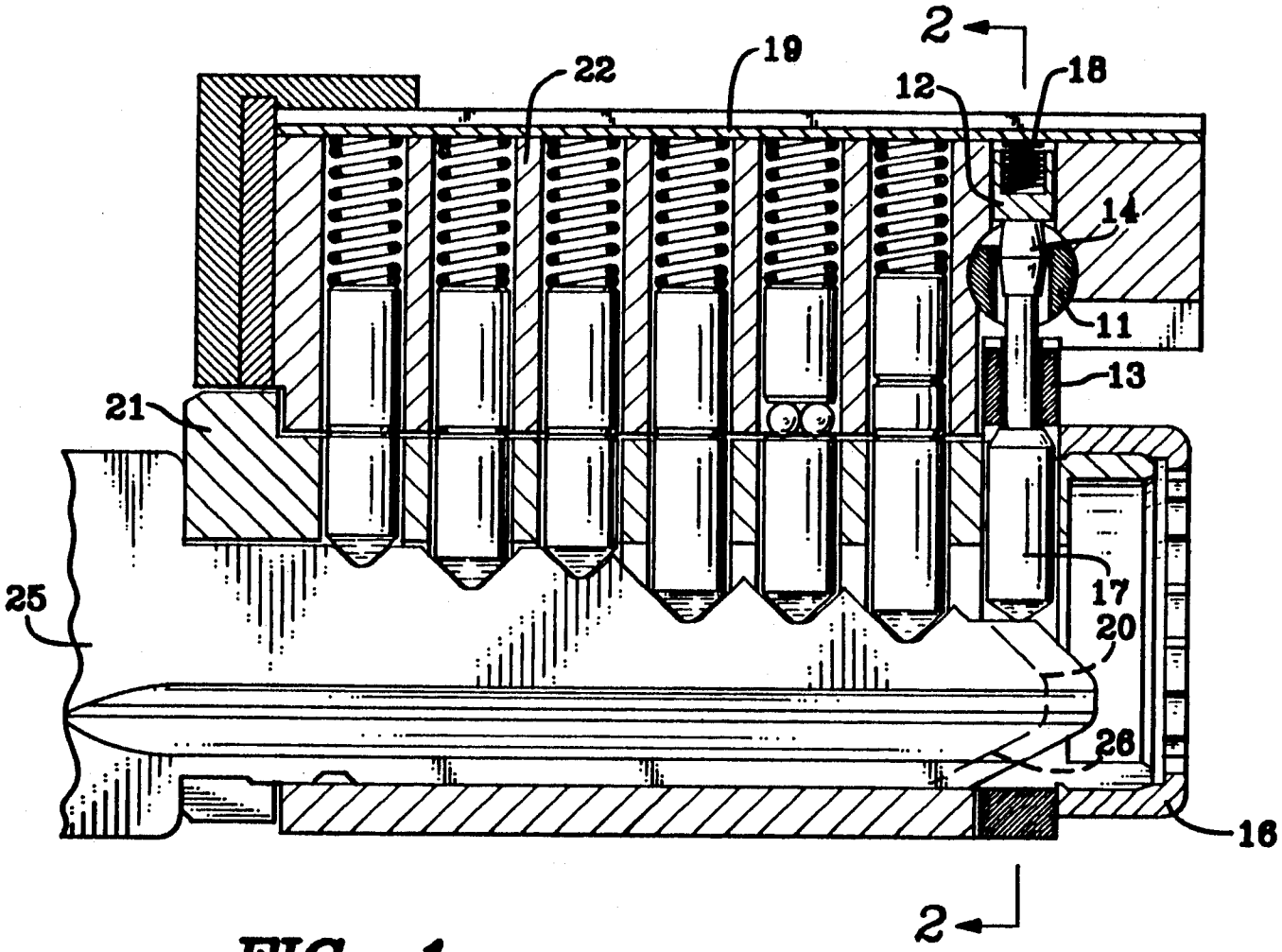
FIG. 1 shows a longitudinal elevation cross section through the core cylinder mechanism of an embodiment of the present invention.

FIG. 1 is a longitudinal cross section of the interchangeable lock core cylinder of the present invention. The lock core body 22 has an upper portion in which the pin chest is located and an attached lower portion which has a cylindrical bore in which the key plug 21 is installed. The function and operation of the key chest is well known in the art and will not be further discussed here. Instead, the discussion will focus on the rightmost portion of the figure, which includes the novel features of this invention. Key plug 21 is inserted in the cylindrical bore and the control pin 17 is installed in the plug. Actuating ring 13 is placed on the plug 21 with the groove 44 on its inside diameter aligned with control pin 17. Key plug cap 16 is installed to capture the assembly within body 22.

Figure 2:
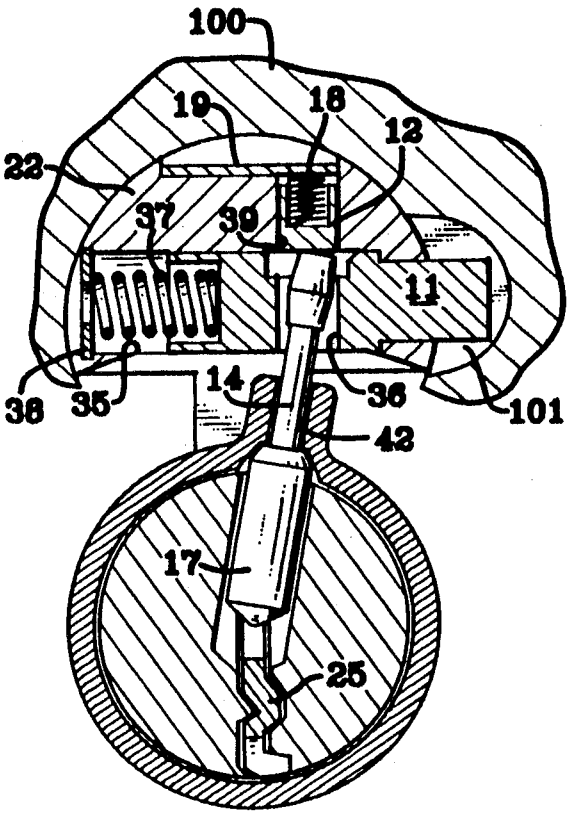
FIG. 2 is a transverse cross section through the core cylinder, viewed from line 2—2 of FIG. 1.

Locking pin 11 is inserted in bore 35 which is transversely oriented in the upper portion of core body 22. Locking pin spring 37 is placed behind locking pin 11 as best seen in FIG. 2 and retained by locking pin spring stop 38 which is secured in core body 22. Actuating pin 14 is inserted downwardly through bore 36 in locking pin 11 and into bore 42 in actuating ring 13. Locking pin stop latch 12 is inserted in latch bore 39 followed by latch spring 18 which is retained within body 22 by cover plate 19.

Control key 25 is shown inserted in key plug 21 in FIG. 1. Dashed line 20 indicates the end of standard key 26. The small additional projection provided on the control key is the only difference between standard key 26 and control key 25.

Referring to FIGS. 1 through 4, it can be seen that insertion of control key 25 into the key plug 21 displaces control pin 17 upward due to the projection which extends beyond dotted line 20 in FIG. 1. Elevation of control pin 17 forces actuating pin 14 upward to the position shown in FIG. 3. Note that this is the retracted position fo bore 35. Locking pin spring 37 is the installation position for the interchangeable core lock cylinder. In the elevated position, control pin 17 also engages actuating ring groove 44 in actuating ring 13. Thus, shear between key plug 21 and actuating ring 13 is no longer possible and the plug and ring rotate together. Actuating pin 14 is capable of axial movement within actuating pin bore 42 of actuating ring 13. This coupling action permits actuating pin 14 to drive locking pin 11 axially within transverse bore 35. Locking pin spring 37 continually urges locking pin 11 rightward in the figures, and absent any restraint from the actuating pin on bore 36, the locking pin will engage locking pin housing slot 101 in housing 100. It can be seen that rotation of the control key by only a few degrees is necessary to change from the locked to the unlocked or removal condition.

Figure 4:
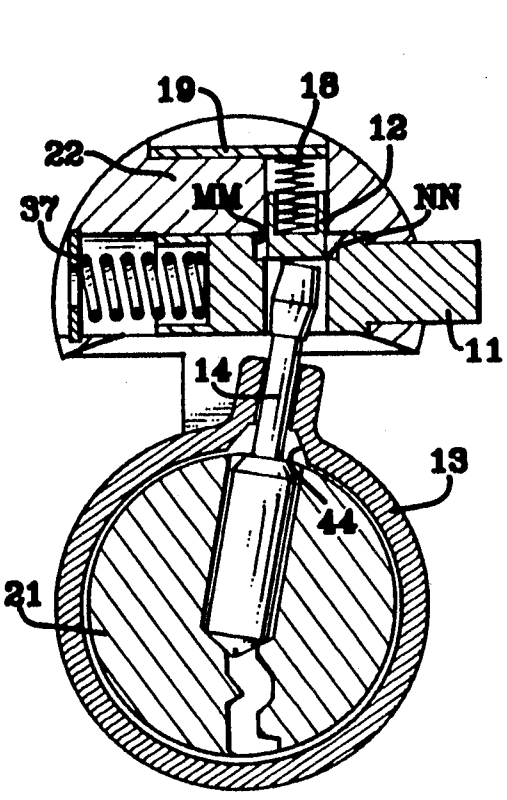
FIGS. 3 and 4 are fragmentary views of the locking pin mechanism of FIG. 2 showing different stages of the locking and latching process in an embodiment of the present invention.
Figure 3:
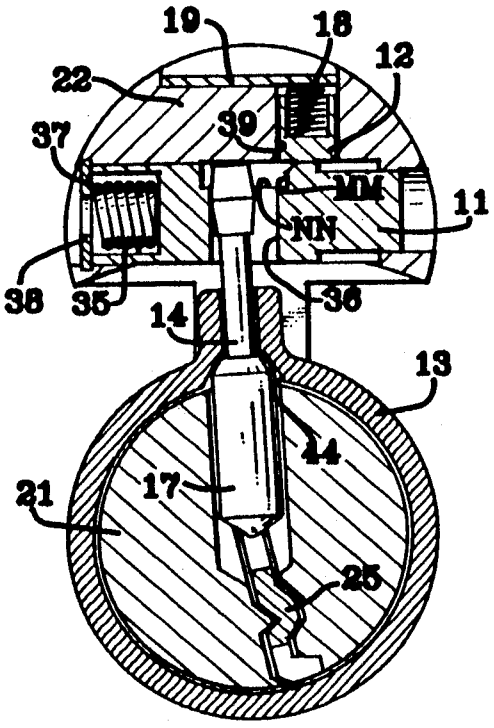

As shown in FIG. 2, the locking pin 11 is engaged in housing slot 101 but is not latched in place because locking pin stop latch 12 is in a retracted position in latch bore 39 due to the elevation of control pin 17 and actuating pin 14. Operation of stop latch 12 is best seen in FIG. 4, where the configuration of FIG. 2 is shown except that actuating pin 14 is retracted so that stop latch 12 is in the latched position.

When locking pin 11 is in its extended position and engaged with housing slot 101, latch bore 39 in the core body 22 is aligned with the step defined in surfaces "M—M" and "N—N" on locking pin 11. Thus, when control key 25 is withdrawn, control pin 17 and actuating pin 14 move downward and are followed by locking pin stop latch 12. Latch spring 18 continually biases stop latch 12 downward so that, whenever the locking pin is extended and the control key removed, stop latch 12 engages locking pin 11 at "N—N" and latches the locking pin in the extended position. In this condition, stop latch 12 rests upon surface "N—N" of locking pin 11, and prevents retraction of the locking pin beyond the point where surface "M—M" of the locking pin encounters the stop latch. To unlatch the locking pin, it is only necessary to insert the control key fully into the key plug slot, thereby forcing actuating pin 14 upward and disengaging the stop latch.

One further consequence of withdrawing the control key 25 from the key plug slot is that control pin 17 moves downward followed by actuating pin 14 so that the contact between the two pins now occurs at the interface between key plug 21 and actuating ring 13. Control pin 17 is no longer engaged in actuating ring groove 44 when in the retracted position. Thus, key plug 21, using standard key 26, can be rotated freely without any effect on the locking pin mechanism. The interchangeable lock core cylinder of the present invention is, thus, easily removed and replaced using the control key described. The locking pin and the locking pin latch mechanism are not affected by use of the standard key.

Having described the invention, what is claimed is:

1. An interchangeable lock core cylinder, for use with a lock housing, comprising:

a cylindrical body;

a pin chest attached to said body and parallel thereto;

a transverse bore in said pin chest containing a locking pin means for engagement in a recess in said housing;

a locking pin stop latch means for preventing retraction of said locking pin means;

a key plug rotatably inserted within said cylindrical body; and a control pin means within the key plug for selectively operating said locking pin means and said stop latch means.

2. The interchangeable lock core cylinder of claim 1, wherein said control pin means selectively operates said locking pin means and said locking pin stop latch means through an actuating ring which is concentric with the cylindrical body, which has a radially oriented bore therethrough, and in which an actuating pin is movably disposed to operate the locking pin means and the locking pin stop latch means when extended; said actuating ring being disabled when said actuating pin is retracted.

3. The interchangeable lock core cylinder of claim 2, wherein the actuating pin is extended by said control pin when said control key is inserted.

4. An interchangeable lock core cylinder for use with a lock housing comprising:

a core body having a cylindrical member and a pin chest attached and parallel thereto;

a key plug rotatably inserted within said core body;

a locking pin disposed in a transverse bore of said pin chest and a locking pin stop latch which coacts with a stepped surface on said locking pin, when said locking pin is extended into engagement with a slot in said housing, so as to prevent retraction of said locking pin from said housing slot; and actuating means for selectively latching and unlatching said locking pin for installation, operation, and removal of said core cylinder from said housing; said actuating means being operable by a control pin with a control key.

5. In a lock mechanism of the type having a housing and an interchangeable core body containing a tumbler mechanism, a key plug, and a locking pin which engages a recess in the housing to retain the interchangeable core therein, the improvement comprising:

means operable only by use of a control key for latching the locking pin in engagement with the housing so that it cannot be inadvertently disengaged therefrom.

6. The improvement of claim 5, wherein the means for latching the locking pin comprises a locking pin stop latch disposed in a recess in said core body and biased toward said locking pin so as to latch the locking pin in an extended position.

7. The improvement of claim 5, further comprising:

means for selectively operating the latching means and the locking pin.

8. The improvement of claim 7, wherein the means for selectively operating the latching means and the locking pin comprises an actuating ring mounted on the key plug; an actuating pin operably associated with said actuating ring, said latching means and said locking pin; and a control pin means within the key plug for operating said actuating pin and said actuating ring.

* * * * *